United States Patent [19]

Le et al.

[11] Patent Number: 4,969,987

[45] Date of Patent: Nov. 13, 1990

[54] INTEGRATED PROCESS FOR PRODUCTION OF GASOLINE AND ETHER

[75] Inventors: Q. N. Le, Cherry Hill; H. Owen, Belle Mead, both of N.J.; P. H. Schipper, Wilmington, Del.

[73] Assignee: Mobil Oil Corporation

[21] Appl. No.: 442,806

[22] Filed: Nov. 29, 1989

[51] Int. Cl.[5] ..... C10G 57/00

[52] U.S. Cl. ..... 208/67; 208/120; 585/310; 585/322; 585/324; 585/649; 585/653; 568/697

[58] Field of Search ..... 208/49, 67; 585/653, 585/310, 324; 568/697, 698, 699, 322

[56] References Cited

U.S. PATENT DOCUMENTS

| | | | |
|---|---|---|---|
| 3,267,156 | 8/1966 | Hansen | 568/698 |
| 3,751,514 | 8/1973 | Hoppstock et al. | 585/653 |
| 3,926,781 | 12/1975 | Gale | 585/653 |
| 4,035,430 | 7/1977 | Dwyer et al. | 568/698 |
| 4,366,327 | 12/1982 | Convers et al. | 568/697 |
| 4,423,251 | 12/1983 | Pujado et al. | 585/654 |
| 4,827,045 | 5/1989 | Harandi et al. | 568/697 |
| 4,911,823 | 3/1990 | Chen et al. | 208/120 |

FOREIGN PATENT DOCUMENTS

| | | | |
|---|---|---|---|
| 0347003 | 12/1989 | European Pat. Off. | 208/120 |

*Primary Examiner*—Anthony McFarlane
*Attorney, Agent, or Firm*—Alexander J. McKillop; Charles J. Speciale; L. G. Wise

[57] ABSTRACT

Process and apparatus for upgrading paraffinic naphtha to high octane fuel by contacting a fresh virgin naphtha feedstock stream medium pore acid cracking catalyst under low pressure selective cracking conditions effective to produce at least 10 wt % C4–C5 isoalkene to obtain a light olefinic fraction rich in C4–C5 isoalkene and a C6+ liquid fraction of enhanced octane value. The preferred feedstock is straight run naphtha containing C7+ alkanes, at least 15 wt % C7+ cycloaliphatic hydrocarbons and less than 20% aromatics, which can be converted with a fluidized bed catalyst in a vertical riser reactor during a short contact period.

The isoalkene products of cracking are etherified to provide high octane fuel components.

16 Claims, 4 Drawing Sheets

INTEGRATED PROCESS FOR PRODUCTION OF GASOLINE AND ETHER

BACKGROUND OF THE INVENTION

This invention relates to production of high octane fuel from naphtha by hydrocarbon cracking and etherification. In particular, it relates to methods and reactor systems for cracking $C_7$+ paraffinic and naphthenic feedstocks, such as naphthenic petroleum fractions, under selective reaction conditions to produce isoalkenes.

There has been considerable development of processes for synthesizing alkyl tertiary-alkyl ethers as octane boosters in place of conventional lead additives in gasoline. The etherification processes for the production of methyl tertiary alkyl ethers, in particular methyl t-butyl ether (MTBE) and t-amyl methyl ether (TAME) have been the focus of considerable research. It is known that isobutylene (i-butene) and other isoalkenes (branched olefins) produced by hydrocarbon cracking may be reacted with methanol, ethanol, isopropanol and other lower aliphatic primary and secondary alcohols over an acidic catalyst to provide tertiary ethers. Methanol is considered the most important $C_1$–$C_4$ oxygenate feedstock because of its widespread availability and low cost. Therefore, primary emphasis herein is placed on MTBE and TAME and cracking processes for making isobutylene and isoamylene reactants for etherification.

SUMMARY OF THE INVENTION

A novel process and operating technique has been found for upgrading paraffinic and naphthenic naphtha to high octane fuel. The primary reaction for conversion of naphtha is effected by contacting a fresh naphtha feedstock stream containing a major amount of C7+ alkanes and naphthenes with medium pore acid cracking catalyst under low pressure selective cracking conditions effective to produce at least 10 wt % selectively C4–C5 isoalkene. The primary reaction step is followed by separating the cracking effluent to obtain a light olefinic fraction rich in C4–C5 isoalkene and a C6+ liquid fraction of enhanced octane value. By etherifying the C4–C5 isoalkene fraction catalytically with lower alcohol (i.e., C1–C4 aliphatic alcohol), a valuable tertiary-alkyl ether product is made. Preferably, the cracking catalyst is substantially free of hydrogenation-dehydrogenation metal components and has an acid cracking activity less than 15 (alpha value) to enhance octane improvement and optimize isoalkene selectivity. Medium pore aluminosilicate zeolites, such as ZSM-5 and ZSM-12 are useful catalyst materials.

These and other objects and features of the invention will be understood from the following description and in the drawing.

DRAWING

FIG. 1 of the drawing is a schematic flow sheet depicting a multireactor cracking and etherification system depicting the present invention;

DETAILED DESCRIPTION

Typical naphtha feedstock materials for selective cracking are produced in petroleum refineries by distillation of crude oil. Typical straight run naphtha fresh feedstock usually contains about at least 20 wt % C7–C12 normal and branched alkanes, at least about 15 wt % C7+ cycloaliphatic (i.e., naphthene) hydrocarbons, and 1 to 40% (preferably less than 20%) aromatics. The C7–C12 hydrocarbons have a normal boiling range of about 65° to 175° C. The process can utilize various feedstocks such as cracked FCC naphtha, hydrocracked naphtha, coker naphtha, visbreaker naphtha and reformer extraction (Udex) raffinate, including mixtures thereof. For purposes of explaining the invention, discussion is directly mainly to virgin naphtha and methanol feedstock materials.

Figure 1:
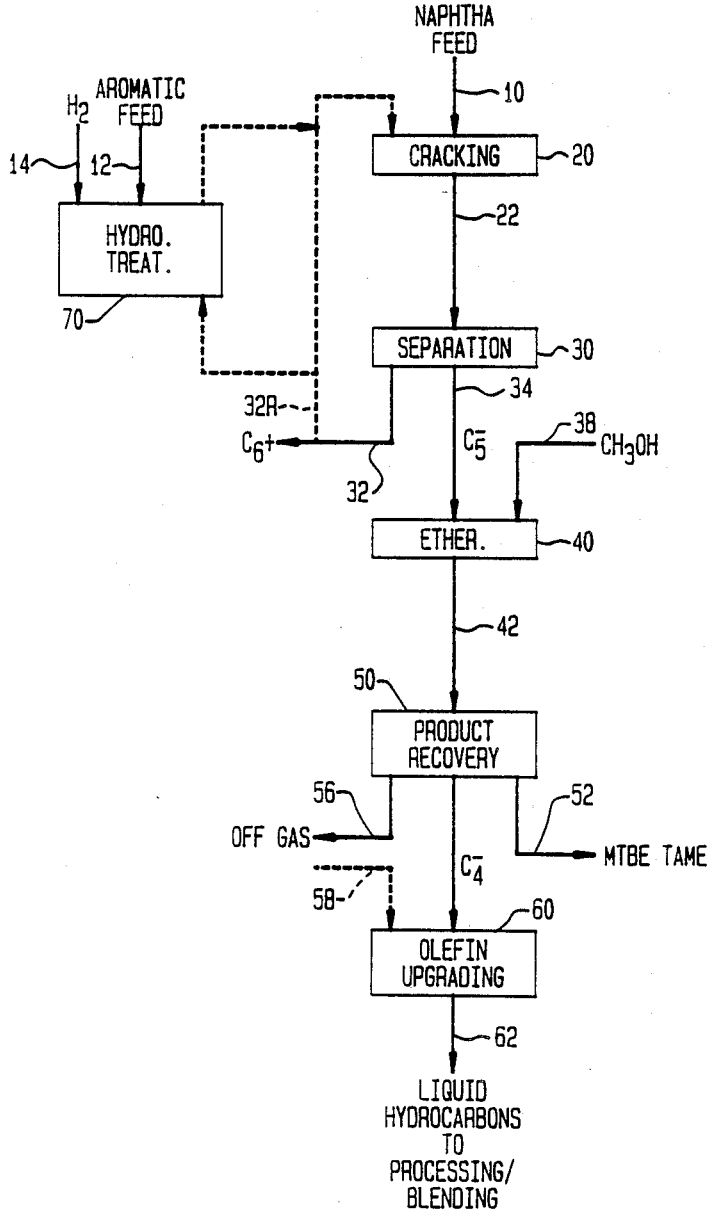

Referring to FIG. 1 of the drawing, the operational sequence for a typical naphtha conversion process is shown, wherein fresh virgin feedstock 10 or hydrocracked naphtha is passed to a cracking reactor unit 20, from which the effluent 22 is distilled in separation unit 30 to provide a liquid C6+ hydrocarbon stream 32 containing unreacted naphtha, heavier olefins, etc. and a lighter cracked hydrocarbon stream 34 rich in C4 and C5 olefins, including i-butene and i-pentenes, non-etherifiable butylenes and amylenes, C1–C4 aliphatic light gas. At least the C4–C5 isoalkene-containing fraction of effluent stream 34 is reacted with methanol or other alcohols stream 38 in etherification reactor unit 40 by contacting the reactants with an acid catalyst, usually in a fixed bed process, to produce an effluent stream 42 containing MTBE, TAME and unreacted C5− components. Conventional product recovery operations 50, such as distillation, extraction, etc. can be employed to recover the MTBE/TAME ether products as pure materials, or as a C5+ mixture 52 for fuel blending. Unreacted light C2–C4 olefinic components, methanol and any other C2–C4 alkanes or alkenes may be recovered in an olefin upgrading feedstream 54. Alternatively, LPG, ethene-rich light gas or a purge stream may be recovered as offgas stream 56, which may be further processed in a gas plant for recovery of hydrogen, methane, ethane, etc. The C2–C4 hydrocarbons and methanol are preferably upgraded in reactor unit 60, as herein described, to provide additional high octane gasoline. A liquid hydrocarbon stream 62 is recovered from catalytic upgrading unit 60 and may be further processed by hydrogenation and blended as fuel components.

An optional hydrotreating unit may be used to convert aromatic or virgin naphtha feed 12 with hydrogen 14 in a conventional hydrocarbon saturation reactor unit 70 to decrease the aromatic content of certain fresh feedstocks or recycle streams and provide a C7+ cycloaliphatics, such as alkyl cyclohexanes, which are selectively cracked to isoalkene. A portion of unreacted paraffins or C6+ olefins/aromatics produced by cracking may be recycled from stream 32 via 32 R to units 20 and/or 70 for further processing. Similarly, such materials may be coprocessed via line 58 with feed to the olefin upgrading unit 60. In addition to oligomerization of unreacted butenes, oxygenate conversion and upgrading heavier hydrocarbons, the versatile zeolite catalysis unit 60 can convert supplemental feedstream 58 containing refinery fuel gas containing ethene, propene or other oxygenates/hydrocarbons.

DESCRIPTION OF ZEOLITE CATALYSTS

Careful selection of catalyst components to optimize isoalkene selectivity and upgrade lower olefins is important to overall success of the integrated process. Under certain circumstances it is feasible to employ the same catalyst for naphtha cracking and olefin upgrading, although these operations may be kept separate with different catalysts being employed. The cracking catalyst may consist essentially of ZSM-12 or the like, having an acid cracking activity less than 15 (standard alpha value) and moderately low constraint index (C.I.=1–12 or lower). The less constrained medium pore zeolite has a pore size of about 5–8A, able to accept naphthene components found in most straight run naphtha from petroleum distillation or other alkyl cycloaliphatics. When cracking substantially linear alkanes, the more constrained ZSM-5 pore structure may be advantageous.

Recent developments in zeolite technology have provided a group of medium pore siliceous materials having similar pore geometry. Prominent among these intermediate pore size zeolites is ZSM-5, which is usually synthesized with Bronsted acid active sites by incorporating a tetrahedrally coordinated metal, such as Al, Ga, Fe, B or mixtures thereof, within the zeolitic framework. These medium pore zeolites are favored for acid catalysis; however, the advantages of medium pore structures may be utilized by employing highly siliceous materials or crystalline metallosilicate having one or more tetrahedral species having varying degrees of acidity. ZSM-5 crystalline structure is readily recognized by its X-ray diffraction pattern, which is described in U.S. Pat. No. 3,702,866 (Argauer, et al.), incorporated by reference.

Zeolite hydrocarbon upgrading catalysts preferred for use herein include the medium pore (i.e., about 5–7A) shape-selective crystalline aluminosilicate zeolites having a silica-to-alumina ratio of at least 12, a constraint index of about 1 to 12 and acid cracking activity (alpha value) of about 1–15 based on total catalyst weight. Representative of the ZSM-5 type medium pore shape selective zeolites are ZSM-5, ZSM-11, ZSM-12, ZSM-22, ZSM-23, ZSM-35, ZSM-48, Zeolite Beta, L, MCM-22, SSZ-25 and mixtures thereof with similarly structured catalytic materials. Mixtures with larger pore zeolites, such as Y, mordenite, or others having a pore size greater than 7A may be desirable. Aluminosilicate ZSM-5 is disclosed in U.S. Pat. No. 3,702,886 and U.S. Pat. No. Re. 29,948. Other suitable zeolites are disclosed in U.S. Pat. Nos. 3,709,979; 3,832,449; 4,076,979; 3,832,449; 4,076,842; 4,016,245; 4,414,423; 4,417,086; 4,517,396; 4,542,257; and 4,826,667. MCM-22 is disclosed in copending application Ser. No. 07/254,524. These disclosures are incorporated herein by reference. While suitable zeolites having a coordinated metal oxide to silica molar ratio of 20:1 to 500:1 or higher may be used, it is advantageous to employ a standard ZSM-5 or ZSM-12, suitably modified if desired to adjust acidity. A typical zeolite catalyst component having Bronsted acid sites may consist essentially of aluminosilicate zeolite with 5 to 95 wt. % silica and/or alumina binder.

Usually the zeolite crystals have a crystal size from about 0.01 to 2 microns or more. In order to obtain the desired particle size for fluidization in the turbulent regime, the zeolite catalyst crystals are bound with a suitable inorganic oxide, such as silica, alumina, etc. to provide a zeolite concentration of about 5 to 95 wt %.

In olefin upgrading reactions, it is advantageous to employ a standard zeolite having a silica:alumina molar ratio of 25:1 or greater in a once-through fluidized bed unit to convert 60 to 100 percent, preferably at least 75 wt. %, of the monoalkenes and methanol in a single pass. Particle size distribution can be a significant factor in transport fluidization and in achieving overall homogeneity in dense bed, turbulent regime or transport fluidization. It is desired to operate the process with particles that will mix well throughout the bed. It is advantageous to employ a particle size range consisting essentially of 1 to 150 microns. Average particle size is usually about 20 to 100 microns.

In addition to the commercial zeolites, medium pore shape selective catalysis can be achieved with aluminophosphates (ALPO), silicoaluminophosphates (SAPO) or other non-zeolitic porous acid catalysts.

FLUIDIZED CATALYST RISER REACTOR CRACKING OPERATION

The selective cracking conditions include total pressure up to about 500 kPa and reaction temperature of about 425° to 650° C., preferrably at pressure less than 175 kPa and temperature in the range of about 450° to 540° C., wherein the cracking reaction produces less than 5% C2− light gas based on fresh naphtha feedstock.

The cracking reaction severity is maintained by employing a weight hourly space velocity of about 1 to 100 (WHSV based on active catalyst solids). While fixed bed, moving bed or dense fluidized bed catalyst reactor systems may be adapted for the cracking step, it is preferred to use a vertical riser reactor with fine catalyst particles being circulated in a fast fluidized bed.

ETHERIFICATION OPERATION

The reaction of methanol with isobutylene and isoamylenes at moderate conditions with a resin catalyst is known technology, as provided by R. W. Reynolds, et al., *The Oil and Gas Journal*, June 16, 1975, and S. Pecci and T. Floris, *Hydrocarbon Processing*, Dec. 1977. An article entitled "MTBE and TAME—A Good Octane Boosting Combo", by J. D. Chase, et al., *The Oil and Gas Journal*, Apr. 9, 1979, pages 149–152, discusses the technology. A preferred catalyst is a sulfonic acid ion exchange resin which etherifies and isomerizes the reactants. A typical acid catalyst is Amberlyst 15 sulfonic acid resin.

Processes for producing and recovering MTBE and other methyl tert-alkyl ethers for $C_4$–$C_7$ iso-olefins are known to those skilled in the art, such as disclosed in U.S. Pat. No. 4,788,365 (Owen et al) and in U.S. Pat. No. 4,885,421, incorporated by reference. Various suitable extraction and distillation techniques are known for recovering ether and hydrocarbon streams from etherification effluent; however, it is advantageous to convert unreacted methanol and other volatile components of etherification effluent by zeolite catalysis.

FLUIDIZED BED OLEFIN UPGRADING REACTOR OPERATION

Zeolite catalysis technology for upgrading lower aliphatic hydrocarbons and oxygenates to liquid hydrocarbon products are well known. Commercial aromatization (M2-Forming) and Mobil Olefin to Gasoline/-Distillate (MOG/D) processes employ shape selective medium pore zeolite catalysts for these processes. It is understood that the present zeolite conversion unit operation can have the characteristics of these catalysts and processes to produce a variety of hydrocarbon products, especially liquid aliphatic and aromatics in the $C_5$–$C_9$ gasoline range.

In addition to the methanol and olefinic components of the reactor feed, suitable olefinic supplemental feedstreams may be added to the preferred olefin upgrading reactor unit. Non-deleterious components, such as lower paraffins and inert gases, may be present. The reaction severity conditions can be controlled to optimize yield of $C_3$–$C_5$ paraffins, olefinic gasoline or $C_6$–$C_8$ BTX hydrocarbons, according to product demand. Reaction temperatures and contact time are significant factors in the reaction severity, and the process parameters are followed to give a substantially steady state condition wherein the reaction severity is maintained within the limits which yield a desired weight ratio of propane to propene in the reaction effluent.

In a dense bed or turbulent fluidized catalyst bed the conversion reactions are conducted in a vertical reactor column by passing hot reactant vapor or lift gas upwardly through the reaction zone at a velocity greater than dense bed transition velocity and less than transport velocity for the average catalyst particle. A continuous process is operated by withdrawing a portion of coked catalyst from the reaction zone, oxidatively regenerating the withdrawn catalyst and returning regenerated catalyst to the reaction zone at a rate to control catalyst activity and reaction severity to effect feedstock conversion.

Upgrading of olefins is taught by Owen et al in U.S. Pat. Nos. 4,788,365 and 4,090,949, incorporated herein by reference. In a typical process, the methanol and olefinic feedstreams are converted in a catalytic reactor under elevated temperature conditions and suitable process pressure to produce a predominantly liquid product consisting essentially of $C_6$+ hydrocarbons rich in gasoline-range paraffins and aromatics. The reaction temperature for olefin upgrading can be carefully controlled in the operating range of about 250° C. to 650° C., preferably at average reactor temperature of 350° C. to 500° C.

Figure 2:
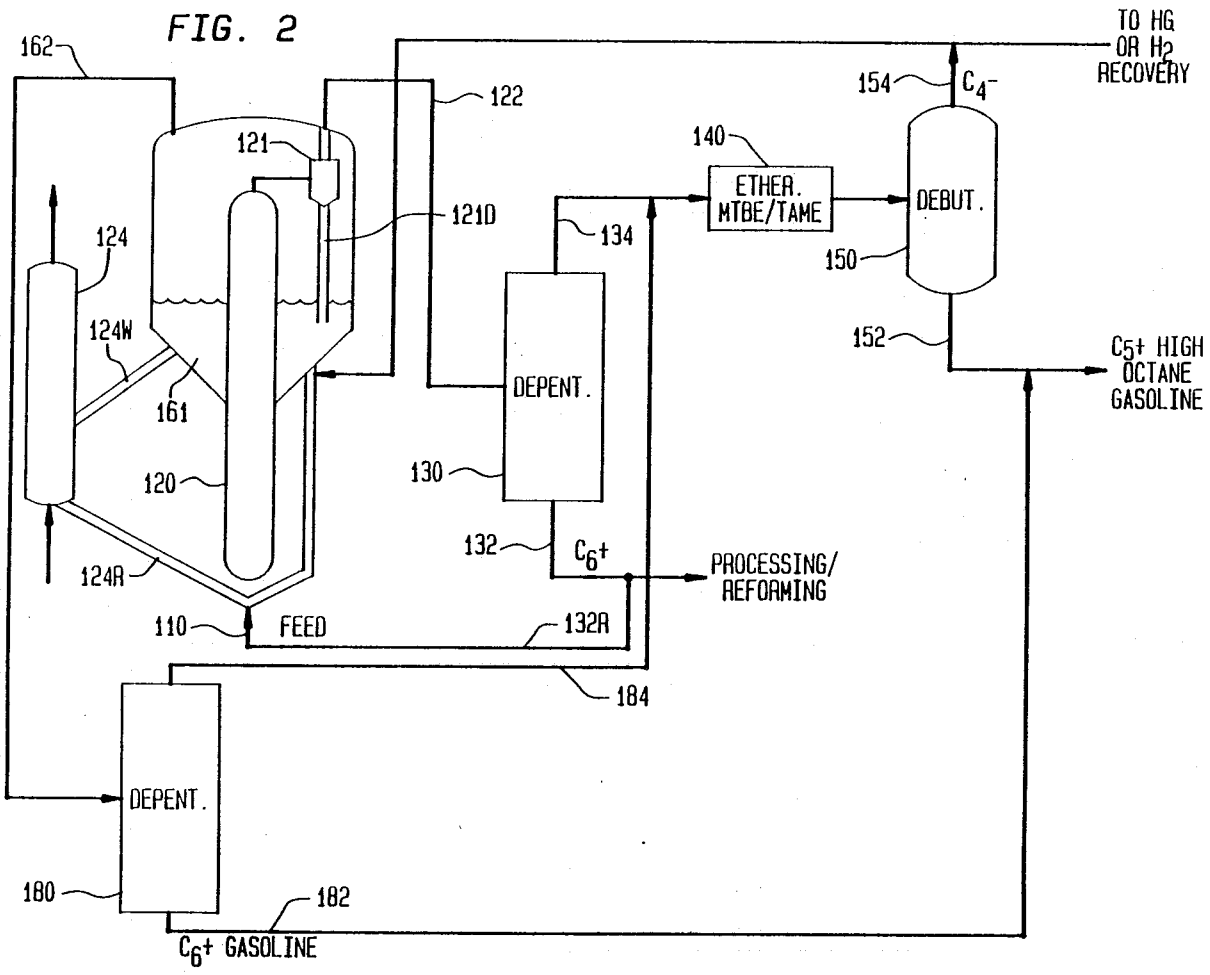
FIG. 2 is a process diagram showing unit operations for a preferred fluidized bed catalytic reactor.

Referring to FIG. 2, a multistage reactor system is shown for upgrading a paraffinic or naphthenic naphtha stream 110 to produce high octane fuel. The system comprises first vertical riser reactor means 120 for contacting preheated fresh naphtha feedstock during a short contact period in a transport regime first fluidized bed of medium pore acid zeolite cracking catalyst under low pressure selective cracking conditions effective to produce at least 10 wt % C4–C5 isoalkene, which is recovered from catalyst solids in cyclone separator 121 and passed via line 122 to depentanizer distillation means 130 for separating cracking effluent 122 to obtain a light olefinic fraction 134 rich in C4–C5 isoalkene and a C6+ liquid fraction 132 having enhanced octane value, but which can be further processed by a low severity reformer (not shown) or recycled via optional line 132R. The C5− stream 134 is passed to second reactor means 140 for etherifying the C4–C5 isoalkene fraction by catalytic reaction with lower alkanol to produce tertiary-alkyl ether product, which is recovered via line 152 from debutanizer distillation means 150 along with overhead stream 154 containing volatile unreacted isoalkene and alkanol from etherification effluent. Debutanizer overhead 154 is then passed to a third reactor means 160 for contacting the volatile etherification effluent with a fluidized bed of medium pore acid zeolite catalyst under olefin upgrading reaction conditions to produce additional gasoline range hydrocarbons, which may be recovered independently from reactor shell 160 via conduit 162 and depentanized in tower 180 to provide blending gasoline stream 182 and a light hydrocarbon stream 184 containing C4–C5 isoalkenes for recycle to ether unit 140.

It may be desired to utilize the same catalyst in cracking and olefin upgrading, as depicted herein, employing a unitary bifunctional reactor configuration 160–120, wherein the fast fluidization transport regime is transposed to a dense bed regime having separated reactants. This can be effected by operatively connecting the reaction zones and providing solid-gas phase separation means 121 for separating cracking catalyst from the first reactor catalyst contact zone and passing the cracking catalyst via cyclone dipleg 121D to the third reactor means catalyst contact zone 161 for upgrading olefin to gasoline.

Recirculation of partially deactivated or regenerated catalyst via conduits 161 and 124R at a controlled rate at the bottom of vertical riser section 120 provides additional heat for the endothermic cracking reaction. Disposing the vertical riser section axially within annular reactor shell 160 can also be advantageous. In addition to economic construction of the reaction vessel, exothermic heat from oligomerization or aromatization of olefins from reactor 160 can be transferred radially between adjacent reaction zones. If additional heat is required for cracking naphtha, hot hydrogen injection can utilized from the C4− debutanizer.

Conventional oxidative regeneration of catalyst can be used to remove coke deposits from catalyst particles withdrawn from reaction section 160 via conduit 124W to contact with air in regeneration vessel 124 and recycle to the riser. Alternatively, hot hydrogen stripping of catalyst in vessel 124 can utilize exterior energy and outside gas source.

Figure 3:
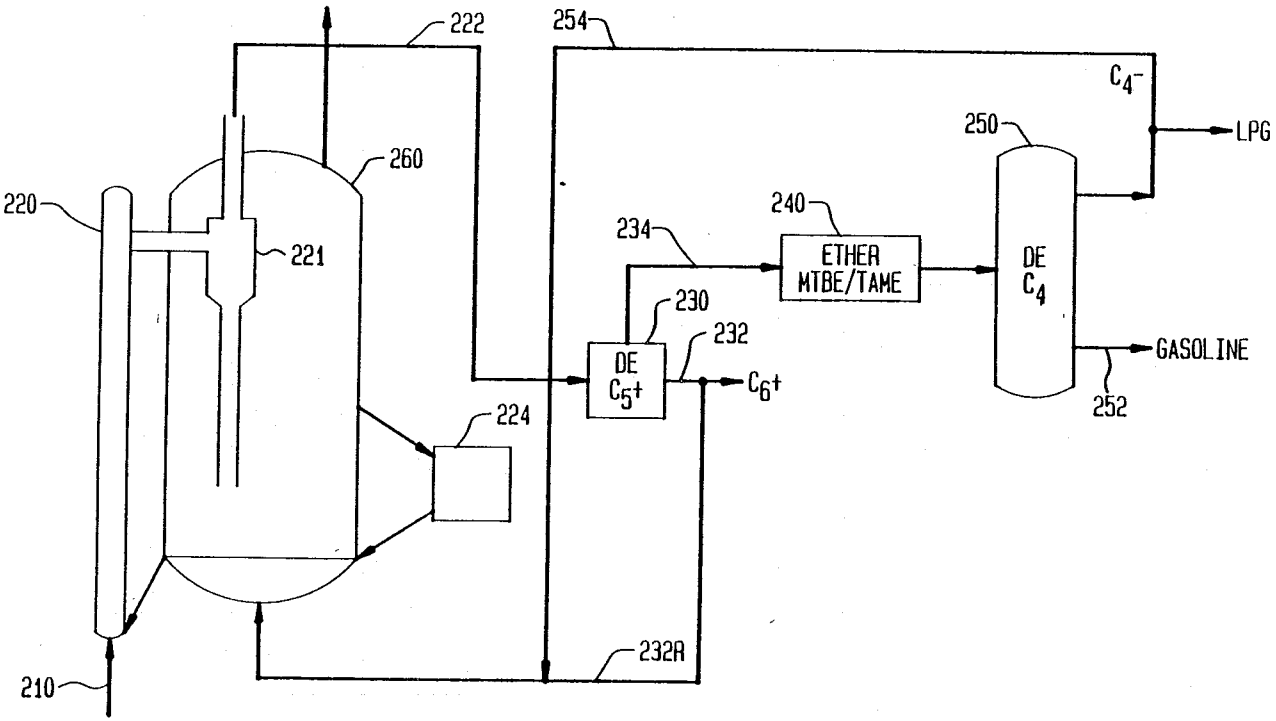
FIG. 3 is an alternative process flow diagram for an integral fluidized bed reactor.

Ordinal numbering is employed in FIG. 2, corresponding to analogous equipment in FIGS. 1 and 3. Referring to FIG. 3, a reactor system is depicted with separate riser vessel 220 and turbulent regime fluidized bed reactor vessel 260, forming a fast bed recirculation loop, wherein equilibrium catalyst from reaction zone 260 is contacted with fresh feed 210 for naphtha cracking. Side regenerator 224 rejuvenates spent catalyst. In this configuration, C6+ hydrocarbon stream 232R and light etherification effluent stream 254 provide feed for conversion to higher octane product by converting olefin and/or paraffin to aliphatic/aromatic product. Process parameters and reaction conditions may be obtained from U.S. Pat. Nos. 4,851,602 4,835,329, 4,854,939 and 4,826,507 (Owen et al.).

Another process modification can employ an intermediate olefin interconversion reactor for optimizing olefin branching prior to etherification. One or more olefinic streams analogous to streams 34, 32R or outside olefins can be reacted catalytically with ZSM-5 or the like, as taught in U.S. Pat. Nos. 4,814,519 and 4,830,635 (Harandi et al.).

Examples of naphtha cracking reactions are demonstrated to show selectivity in producing isoalkenes. Unless otherwise indicated, the example employ standard H-ZSM-12 zeolite catalyst (C.I.=2), steamed to reduce the acid cracking activity (alpha value) to about 11. The test catalyst is 65% zeolite, bound with alumina, and extruded. The feedstocks employed are virgin light naphtha fractions (150°-350° F./65°-165° C.) consisting essentially of C7-C12 hydrocarbons, as set forth in Table 1.

TABLE 1

| Feedstock (Straight Run Naphtha) | Arab Light Paraffinic Naph | Nigerian Naphthenic Naph |
|---|---|---|
| Boiling Point, °F. | C7-350 | C7-330 |
| API Gravity | 58.6 | 53.4 |
| H, wt % | 14.52 | 14.33 |
| S, wt % | 0.046 | 0.021 |
| N, ppm | 0.3 | 0.5 |
| Composition, wt % | | |
| Paraffins | 65 | 33 |
| Naphthenes | 21 | 57 |
| Aromatics | 14 | 10 |

Several runs are made at about 500°-540° C. (960°-1000° F.), averaging 1-2 seconds contact time at WHSV 1-4, based on total catalyst solids in a fixed bed reactor unit at conversion rates from about 20-45%. Results are given in Table 2, which shows the detailed product distribution obtained from cracking these raw naphtha over ZSM-12 catalyst (65% zeolite, 35% alumina binder, 11 alpha) in a fixed-bed catalytic reactor at 35 psig N2 atmosphere.

TABLE 2

| | Selective Naphtha Cracking Over ZSM-12 | | | | | |
|---|---|---|---|---|---|---|
| Run # | 1 | 2 | 3 | 4 | 5 | 6 |
| SR Naphtha | | Arab Light | | | Nigerian | |
| Avg Rx T, °F. | 1000 | 976 | 967 | 965 | 972 | 960 |
| WHSV | 4 | 4 | 2 | 2 | 4 | 2 |
| Hr. on Stream | 3 | 22 | 26 | 44 | 3 | 6 |
| C5- Conv., wt % | 30.8 | 22.9 | 41.2 | 23.4 | 45.5 | 40.7 |
| Product Selectivity, % | | | | | | |
| C1-C2 | 4.1 | 1.7 | 3.3 | 2.8 | 3.4 | 3.2 |
| C3 | 8.6 | 7.8 | 5.7 | 5.3 | 10.6 | 6.9 |
| nC4 | 6.2 | 5.9 | 7.5 | 5.2 | 6.2 | 4.1 |
| iC4 | 4.6 | 4.2 | 6.1 | 3.9 | 8.3 | 5.3 |
| nC5 | 2.3 | 2.4 | 2.7 | 2.9 | 2.1 | 1.8 |
| iC5 | 2.1 | 2.4 | 2.7 | 3.5 | 3.3 | 2.4 |
| C2= | 6.8 | 5.9 | 4.9 | 4.4 | 6.4 | 5.9 |
| C3= | 32.6 | 31.8 | 28.9 | 29.5 | 28.7 | 31.7 |
| nC4= | 15.0 | 16.0 | 15.5 | 18.6 | 13.9 | 17.2 |
| iC4= | 11.1 | 11.6 | 11.0 | 12.5 | 9.5 | 11.7 |
| nC5= | 2.2 | 2.6 | 3.6 | 3.5 | 2.4 | 3.0 |
| iC5= | 4.4 | 5.5 | 8.1 | 7.9 | 5.2 | 6.8 |
| C2= to C5= | 72.1 | 73.4 | 72.0 | 76.4 | 66.1 | 76.3 |

These data show that significant conversion of the paraffins and naphthene at these conditions do occur to produce iso-alkenes in good yield. The other products include straight chain C4-C5 olefins, C2-C3 olefins and C1-C4 aliphatics. The reaction rate is stable, with small drop inconversion as the time on stream is increased from 3 to 24 hours. This drop in conversion can be compensated by decreasing space velocity.

Table 3 shows increase of RON Octane from unconverted naphtha products with zeolite conversion to C6+ liquid.

TABLE 3

| Run # | Conversion, wt % | RON Octane |
|---|---|---|
| Arab Light SRN | Feed | 51.9 |
| -1 | 30.8 | 60.6 |
| -2 | 22.9 | 60.4 |
| -3 | 41.2 | 60.3 |
| Nigerian SRN | Feed | 64.2 |
| -5 | 45.5 | 68.6 |

TABLE 3-continued

| Run # | Conversion, wt % | RON Octane |
|---|---|---|
| -6 | 40.7 | 66.6 |

Figure 4:
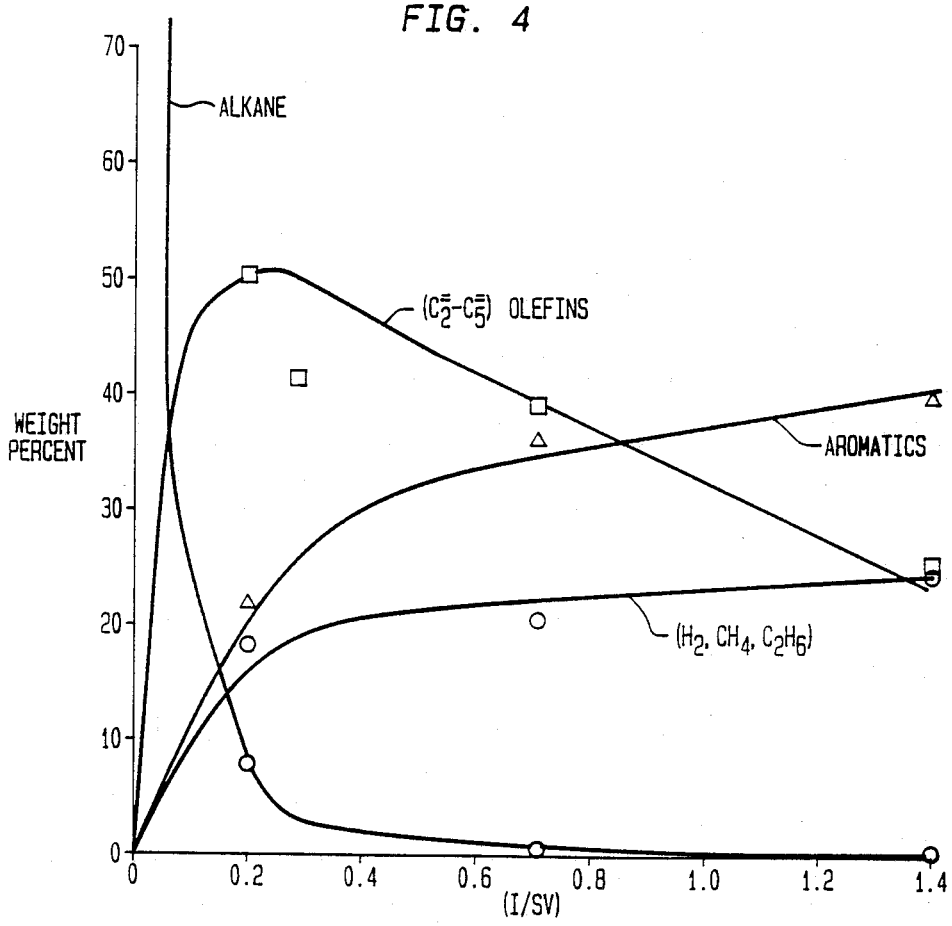
FIG. 4 is a graphic plot showing reaction pathways and operating conditions for optimizing olefin yield.

Typical n-alkane conversion with medium pore zeolite (H-ZSM-5) is shown in FIG. 4, at varying space velocities. This series of reaction curves plots the yield of C2-C5 olefins and paraffin conversion vs. 1/LHSV space velocity. These data show the peaking of olefin yield low on the aromatics curve at relatively high space velocity, indicating preferred zone of operation at space velocity equivalent to 1-10 WHSV based on active catalyst solids.

Fluidized bed configuration is preferred, particularly at high temperature (800°-1200° F.) and short-contact time (<10 sec) conditions. Moving-bed and fixed-bed reactors are also viable for high activity and stable catalysts which might not require frequent regeneration. Prefered process conditions for fixed and moving-bed configuration would be in low reactor temperature (500°-800° F.), low space velocities (0.25-3 WHSV) and under the hydrogen atmosphere, if possible, to maintain catalyst stabilities.

Another process variation contemplates optimizing zeolite isomerization of C4— ether reaction effluent components to produce additional isobutene and isoamylenes for recycle and/or lighter olefins for further upgrading by zeolite catalysis.

Various modifications can be made to the system, especially in the choice of equipment and non-critical processing steps. While the invention has been described by specific examples, there is no intent to limit the inventive concept as set forth in the following claims.

We claim:

1. A process for upgrading paraffinic naphtha to high octane fuel comprising:

contacting a fresh naphtha feedstock stream containing a major amount of $C_7$+ alkanes and naphthenes with medium pore acid cracking catalyst under low pressure selective cracking conditions effective to produce at least 10 wt % selectivity $C_4$-$C_5$ isoalkene, said cracking catalyst being substantially free of hydrogenation-dehydrogenation metal components and having an acid cracking activity less than 15; wherein the fresh feedstock contains at least about 20 wt % $C_7$–$C_{12}$ alkanes, at least about 15 wt % $C_7$+ cycloaliphatic hydrocarbons, and less than 40 wt % aromatics; the cracking conditions include total pressure up to about 500 kPa, space velocities greater than 1/hr WHSV, and reaction temperature of about 425° to 650° C.; the cracking catalyst comprises metallosilicate zeolite having a constraint index of about 1 to 12; and wherein the cracking reaction produces less than 5% $C_2$ light gas based on fresh naphtha feedstock;

separating cracking effluent to obtain a light olefinic fraction rich in $C_4$–$C_5$ isoalkene and a $C_6$+ liquid fraction of enhanced octane value; and etherifying the $C_4$–$C_5$ isoalkene fraction by catalytic reaction with lower alkanol to produce tertiary-alkyl ether product.

2. A process for upgrading naphtha comprising naphthenes according to claim 1 wherein the cracking catalyst consists essentially of ZSM-12; the cracking reaction is maintained at about 450° to 540° C. and weight hourly space velocity of about 1 to 100/hr; and wherein the fresh feedstock consists essentially of C7+ paraffinic virgin petroleum naphtha boiling in the range of about 65° to 175° C.

3. A process for upgrading paraffinic naphtha to high octane fuel according to claim 1 wherein cracking effluent is fractionated to obtain a $C_6$+ fraction, and at least a portion of the $C_6$+ fraction from cracking effluent is recycled with fresh feedstock for further conversion under cracking conditions; and wherein isobutene and isoamylene recovered from naphtha cracking are etherified with methanol to produce methyl t-butyl ether and methyl t-amyl ether.

4. A process for upgrading paraffinic naphtha to high octane fuel by contacting a fresh virgin naphtha feedstock stream containing predominantly $C_7$–$C_{12}$ alkanes and naphthenes with a fluidized bed of solid medium pore acid zeolite cracking catalyst under low pressure selective cracking conditions effective to produce at least 10 wt % selectivity $C_4$–$C_5$ isoalkene, said cracking catalyst being substantially free of hydrogenation-dehydrogenation metal components; and separating cracking effluent to obtain a light olefinic fraction rich in $C_4$–$C_5$ isoalkene and a $C_6$+ liquid fraction of enhanced octane value containing less than 50 wt % aromatic hydrocarbons.

5. A process for upgrading paraffinic naphtha to high octane fuel according to claim 4 wherein the fresh feedstock contains at least 15 wt % C7+ cycloaliphatic hydrocarbons and less than 20% aromatics; the cracking conditions include total pressure up to about 500 kPa and reaction temperature of about 425° to 650° C.; the cracking catalyst comprises aluminosilicate zeolite ZSM-12 having an acid cracking activity less than 15.

6. A process for upgrading paraffinic naphtha to high octane fuel according to claim 4 wherein petroleum naphtha containing aromatic hydrocarbon is hydrotreated to convert aromatic components to cycloaliphatic hydrocarbons to provide fresh feedstock containing less than 5% aromatics.

7. The process of claim 4 wherein the fluidized bed catalyst is contacted with the feedstock in a vertical riser reactor during a short contact period which is sufficient to produce said at least 10% $C_4$–$C_5$ isoalkene in a transport regime and wherein said catalyst is separated from said isoalkylene and is recycled to said upgrading step.

8. The process of claim 7 wherein the contact period is less than 10 seconds, and the space velocity is greater than 1, based on active zeolite catalyst solids.

9. A process for upgrading paraffinic naphtha to high octane fuel comprising:

contacting a fresh paraffinic petroleum naphtha feedstock stream having a normal boiling range of about 65° to 175° C. with a first fluidized bed of medium pore acid zeolite cracking catalyst under low pressure selective cracking conditions effective to produce at least 10 wt % selectively C4–C5 isoalkene, said cracking catalyst being substantially free of hydrogenation-dehydrogenation metal components and having an acid cracking activity less than 15;

separating cracking effluent to obtain a light olefinic fraction rich in C4–C5 isoalkene and a C6+ liquid fraction of enhanced octane value;

etherifying the C4–C5 isoalkene fraction by catalytic reaction with lower alkanol to produce tertiary-alkyl ether product; and recovering volatile unreacted isoalkene and alkanol from etherification effluent and contacting the volatile effluent with a second fluidized bed of medium pore acid zeolite catalyst under olefin upgrading reaction conditions to produce additional gasoline range hydrocarbons.

10. A process for upgrading paraffinic naphtha to high octane fuel according to claim 9 wherein the fresh feedstock contains about C7–C10 alkanes cycloaliphatic hydrocarbons, and is substantially free of aromatics; the cracking conditions include total pressure up to about 500 kPa and reaction temperature of about 425° to 650° C.; the cracking catalyst comprises metallosilicate zeolite having a constraint index of about 1 to 12; and wherein the cracking reaction produces less than 5% C2− light gas based on fresh naphtha feedstock.

11. A process for upgrading paraffinic naphtha to high octane fuel according to claim 10 wherein the cracking catalyst consists essentially of ZSM-12; the cracking reaction is maintained at about 450° to 540° C. and weight hourly space velocity of about 1 to 4.

12. A process for upgrading paraffinic naphtha to high octane fuel according to claim 9 wherein cracking effluent is fractionated to obtain a $C_6$+ fraction, and at least a portion of the $C_6$+ fraction from cracking effluent is recycled with fresh feedstock for further conversion under cracking conditions; and wherein isobutene and isoamylene recovered from naphtha cracking are etherified with methanol to produce methyl t-butyl ether and methyl t-amyl ether.

13. A process for upgrading naphtha-range $C_7$+ paraffinic hydrocarbon to isoalkene-rich product including the steps of:

contacting the hydrocarbon feedstock with acid zeolite cracking catalyst under low pressure selective cracking conditions and reaction temperature of about 425° to 650° C. to provide at least 10 wt % selectivity to $C_4$–$C_5$ isoalkene; and separating cracking effluent to obtain a light olefinic fraction rich in $C_4$–$C_5$ isoalkene and a $C_6$+ liquid fraction of increased octane value containing less than 5 wt % $C_2$− light cracked gas;

said cracking catalyst comprising medium pore aluminosilicate zeolite selected from ZSM-5, ZSM-11, ZSM-12, ZSM-22, ZSM-23, MCM-22 and mixtures thereof with one another or mixtures of said medium pore zeolite with larger pore zeolite and said cracking catalyst being substantially free of hydrogenation-dehydrogenation metal components.

14. A process for upgrading naphtha to high octane fuel according to claim 13 wherein fresh feedstock is selected from virgin straight run petroleum naphtha, hydrocracked naphtha, coker naphtha, visbreaker naphtha, and reformer extract raffinate contains at least 15 wt % C7+ cycloaliphatic hydrocarbons and about 1 to 40% aromatics; the cracking conditions include total pressure up to about 500 kPa, said aluminosilicate zeolite having an acid cracking activity less than 15.

15. The process of claim 13 wherein fluidized bed catalyst comprising said aluminosilicate zeolite is contacted with paraffinic petroleum naphtha feedstock in a vertical riser reactor during a short contact period which is sufficient to produce said at least 10% $C_4$–$C_5$ isoalkene in a transport regime and wherein said catalyst is separated from said isoalkylene and is recycled to said upgrading step.

16. The process of claim 15 wherein the contact period is less than 10 seconds, and the space velocity is greater than 1/hr, based on active zeolite catalyst solids.

* * * * *